United States Patent [19]

Tanaka

[11] Patent Number: 4,525,632

[45] Date of Patent: Jun. 25, 1985

[54] STARTER MOTOR FOR AN INTERNAL COMBUSTION ENGINE

[75] Inventor: Toshinori Tanaka, Himeji, Japan

[73] Assignee: Mitsubishi Denki Kabushiki Kaisha, Tokyo, Japan

[21] Appl. No.: 461,981

[22] Filed: Jan. 26, 1983

[30] Foreign Application Priority Data

Feb. 2, 1982 [JP] Japan ..... 57-13900[U]

[51] Int. Cl.[3] ..... F02N 11/00

[52] U.S. Cl. ..... 290/38 R; 290/38 A; 290/38 B; 290/48; 310/87; 310/88; 74/7 A; 74/7 B; 74/7 R

[58] Field of Search ..... 290/38 A, 38 B, 38 C, 290/38 E, 38 R, 38, 48; 74/6, 139, 7 A, 7 B, 7 R; 310/87, 88, 89, 42, 154

[56] References Cited

U.S. PATENT DOCUMENTS

| | | | |
|---|---|---|---|
| 2,685,042 | 7/1954 | Klett | 310/68 R X |
| 3,200,272 | 8/1965 | Wagner | 310/50 X |
| 3,319,093 | 5/1967 | Abdul | 310/87 X |
| 3,683,219 | 8/1972 | Kruse | 310/171 X |
| 3,766,453 | 10/1973 | Schenk et al. | 310/88 |
| 4,080,541 | 3/1978 | Mazzorana | 310/89 |
| 4,154,117 | 5/1979 | Mazzorana | 74/7 A |
| 4,206,656 | 6/1980 | Hollyoak | 74/7 A X |

*Primary Examiner*—S. J. Witkowski
*Assistant Examiner*—Paul S. L. Ip
*Attorney, Agent, or Firm*—Wenderoth, Lind & Ponack

[57] ABSTRACT

A reduction gear type D.C. starter motor for an internal combustion engine including a planetary type reduction gear system mounted in a front bracket at a faucet joint portion between it and a rear bracket, the rear bracket and the yoke being integrally formed.

7 Claims, 2 Drawing Figures

STARTER MOTOR FOR AN INTERNAL COMBUSTION ENGINE

BACKGROUND OF THE INVENTION

The present invention relates to a reduction gear type starter motor for an internal combustion engine and more particularly to an improvement in a starter motor for an automobile engine wherein a planetary type reduction gear is installed.

One of the typical starter motors of this kind as has been hitherto known as shown in FIG. 1 of the attached drawings. In FIG. 1 there is shown a starter motor 1 of this kind having a planetary type reduction gear, a direct current motor 2, and a field system 3 of motor 2 comprising a cylindrical yoke 4 and poles 5 secured to the inner periphery of yoke 4, poles 5 being permanent magnets, a rear bracket 6 secured to yoke 5 at its rear end and a ball bearing 7 mounted to the inner periphery of the protrusion 6*a* projected outwards from rear bracket 6 centrally thereof rotatively supporting the rear end portion of the rotary shaft 9 constituting a part of armature 8. Also part of direct current motor 2 is a commutator 10 fit on rotary shaft 9, an armature core 11, armature coils 12 mounted in the grooves of armature core 11, the lead wires thereof 12*a* being connected to commutator 10, brushes 13 in sliding contact with commutator 10, and thrust washers 14, 15 and 16. A spur gear 17 is mounted on the forward portion of rotary shaft 9 which is in mesh with planetary gears 18 of a planetary type reduction gear so that the torque of armature 8 is transmitted to gears 18. A ring-gear 19 (internal gear) fits together with a flange 20 into the annular groove 21*a* of an intermediate bracket 21 which is in turn connected to yoke 4 through a faucet joint, groove 21*a* constituting a part of thereof. An overrunning clutch 22 is connected to an output rotary shaft 23 by splines and adapted to be energized by the revolution of planetary gears 18. A pinion 24 is fixedly secured to overunning clutch 22 and adapted to be rotated in one direction only. A shift lever 25 engages overrunning clutch 22 so as to shift it forward. A front bracket 26 mounts a sleeve bearing 27 in the inner periphery of its forward end portion centrally thereof, bearing 27 rotatively supporting the forward end of output rotary shaft 23. A stopper 28 is provided to constrain the excessive forward movement of overrunning clutch 22. A thrust washer 29 is provided to bear thrust load generated in output rotary shaft 23. Also provided is a grommet 30, one end of which is born against a magnetic switch 31 and carries the pivotal part of shift lever 25 between it and the inner protruded portion 26*a* of front bracket 26 so as to put the rotary part therebetween. Intermediate bracket 21 has its rear end connected to yoke 4 through the faucet joint as above described, the front end being connected to front bracket 26 through a faucet joint as well, whereby intermediate bracket 21 and yoke 4 are held in position by through bolts (not shown) passing through near the inner peripheries of rear bracket 6, yoke 4, intermediate bracket 21 and front bracket 26 from rear bracket 6 to front bracket 26 with the ends of the bolts being secured to both brackets 6 and 26, respectively, as by screwing.

The conventional reduction gear starter motor having such a constitution as above stated operates as follows:

Energization of magnetic switch 31 operates shift lever 25 to move overrunning clutch 22 forward so that thereby pinion 24 is caused to mesh with a ring-gear (not shown) of an internal combustion engine, and succeedingly the main contacts (not shown) of magnetic switch 31 are closed and a voltage is applied to brushes 13 from an electric current source (not shown) to cause an electric current to flow through armature 8, to cause armature 8 to rotate and torque to be transmitted to planetary gears 18 through spur gear 17 mounted to rotary shaft 9, whereby torque is transmitted further through the route of output rotary shaft 23, overrunning clutch 22 and pinion 24 in this order under the decrease of the rotational speed, the torque finally transmitted to the internal combustion engine through pinion 24 and the ring-gear now in mesh with each other. Although the representation is omitted in FIG. 1, the front end of rotary shaft 9 of armature 8 is rotatively carried by output rotary shaft 23, the rear end of which is rotatively carried by flange 20, with necessary machining accuracies being maintained between the relative rotational parts.

From the foregoing, it will be apparent that the conventional starter motor has various defects in that the brackets to rotatively support rotary shaft 9 are constituted separately, and in particular, intermediate bracket 21 is a fundamental factor in reducing the accuracy of alignment of the bearing portions of rotary shaft 9 and output rotary shaft 23. It is a further drawback of the conventional starter motor that it requires a considerable number of constitutional elements, bring about disadvantages in manufacturing costs, etc.

SUMMARY OF THE INVENTION

It is an object of the present invention to provide a reduction gear type starter motor for an internal combustion engine which can eliminate various defects in the conventional one as exemplified above.

It is another object of the present invention to provide a reduction gear type starter motor for an internal combustion engine wherein the concentricity of a rotary shaft and bearings is assured.

It is a further object of the present invention to provide a reduction gear type starter motor for an internal combustion engine which can reduce the infiltration of water through the engaging portion of the confronting housing portions into the housing, making possible realization of a waterproof constitution and reducing the grounding circuit resistance at the engaging portion.

In accordance with the present invention a reduction gear type starter motor is provided wherein a planetary type reduction gear system is contained within an annular groove formed in a front bracket, the groove constituting a part of a faucet joint between it and a yoke of a direct current motor, and the yoke and a rear bracket are integrally constituted, the yoke and the front braket being fixedly secured together by means of a number of through bolts passing through them with the ends of the bolts being suitably secured to the yoke and the front bracket, respectively.

BRIEF DESCRIPTION OF THE DRAWINGS

Other objects of the present invention and the invention itself will become more apparent from the following detailed description and the appended drawings, in which.

DESCRIPTION OF THE PREFERRED EMBODIMENT

Figure 2:
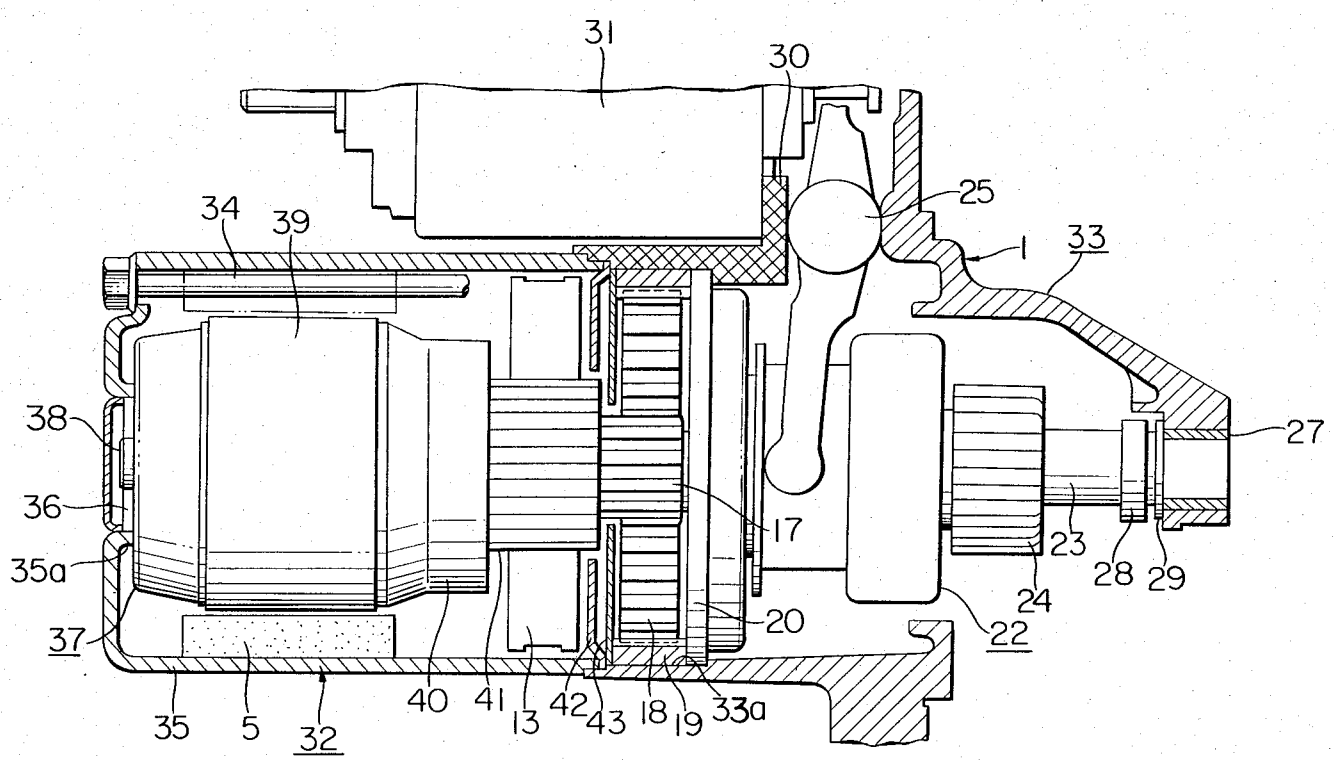
FIG. 2 is a similar view of FIG. 1 of one embodiment of the present invention.

Referring now to FIG. 2 of the drawings wherein is shown schematically an embodiment of the present invention in a longitudinal sectional view, the reference numeral 32 denotes a direct current motor which is connected to a front bracket 33 through a faucet joint, an annular groove 33*a* formed in bracket 33 constituting a part thereof, and front bracket 33 and motor 32 being connected together by means of a number of through bolts 34 passing through them with the ends of the bolts being suitably secured to them, respectively, such as by being screwed thereto. A cylindrical yoke 35 of motor 32 has poles 5 secured to the inner periphery of the mid-portion thereof and has a ball bearing 36 fit in a protrusion 35*a* formed in the inner surface at the rear end centrally thereof, ball bearing 36 rotatively supporting the rear end of a rotary shaft 38 of armature 37. motor 32 also includes an armature core 39, armature coils 40, a commutator 41, a brush-holder base 42 to mount brushes 13, and a disc 43. Front bracket 33 mounts in annular groove 33*a* of the faucet joint a ring gear 19, a flange 20, bush-holder base 42 and disc 43, whereby these elements 19, 42 and 43 are held in position, as shown in FIG. 2, by the transverse force of yoke 35 derived from the fastening of the through bolts 34.

Figure 1:
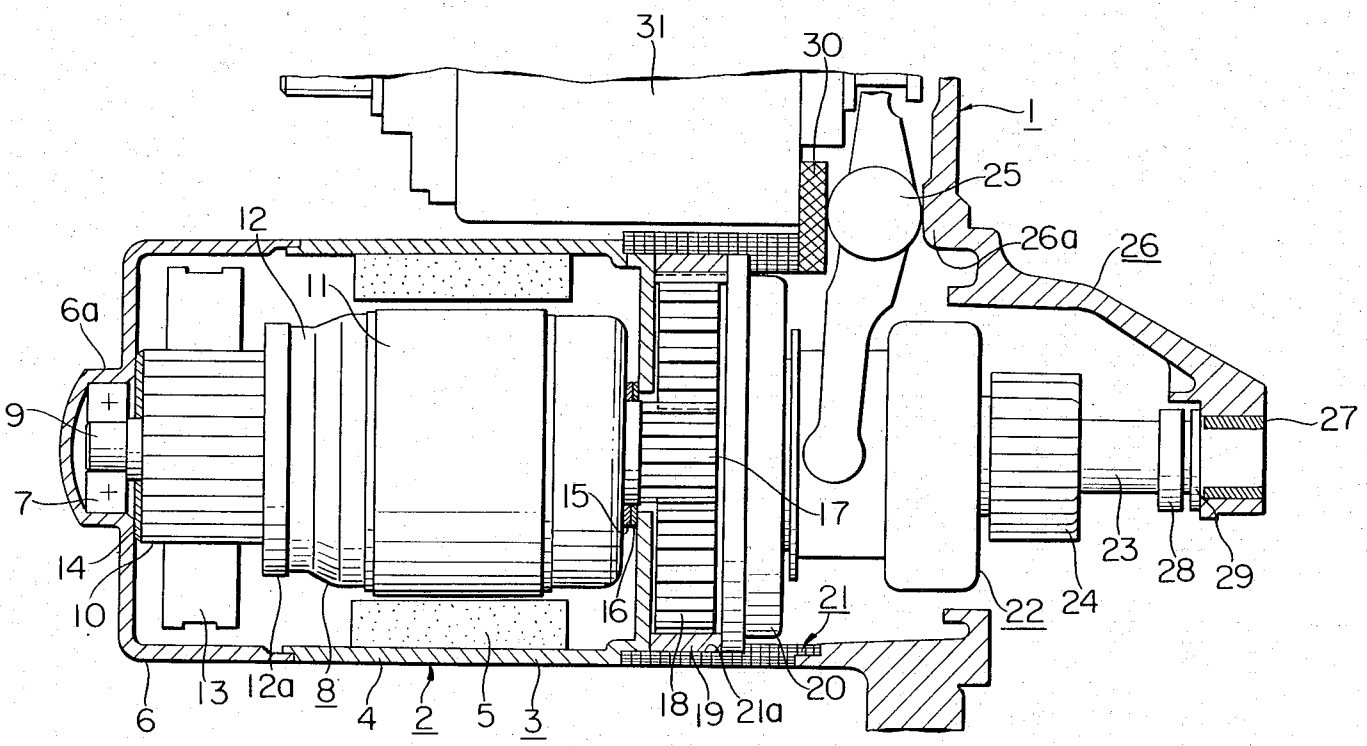
FIG. 1 PRIOR ART
FIG. 1 is a longitudinal sectional side view of a principal part of a conventional reduction gear type starter motor.

The various elements other than those specifically described above are affixed in the drawing with the same reference numerals as in FIG. 1 as representing the elements similar or corresponding to those in FIG. 1.

In the starter motor in accordance with the present invention having the constitution as above described, direct current motor 32 and front bracket 33 are connected together only at one portion, i.e. the faucet joint, a part of which is constituted by annular groove 33*a* of front bracket 33, eliminating an intermediate bracket and a rear bracket which are indispensable in the conventional starter motor as shown in FIG. 1, so that the fundamental constitution is more simplified than the conventional one and at the same time the accuracy of the motor, in particular the concentricity of rotary shaft 38 and output rotary shaft 23, is increased. Further, since brush-holder base 42 is so constituted that it directly abuts front bracket 33 the grounding circuit resistance can be minimized. Moreover, when front bracket 33 is manufactured from aluminum composite alloy by a die casting process the metal die is able to be constituted as a two surface split type so that productivity is increased, reducing the manufacturing costs.

Although a single preferred embodiment of the present invention has been described and illustrated, it will be understood by those skilled in the art that modifications may be made in the structure, form and relative arrangement of parts without necessarily departing from the spirit and the scope of the present invention.

What is claimed is:

1. In a reduction gear type starter motor having a yoke and poles for an internal combustion engine having a rear, an intermediate and a front bracket, the motor being interposed between said rear and intermediate brackets, said intermediate bracket containing gear trains in mesh with the rotary shaft of said motor, said front bracket containing an overrunning clutch mounted to the output rotary shaft of said gear trains and a shift lever to actuate said overrunning clutch, a pinion secured to said overrunning clutch being adapted to be meshed with a gear of said internal combustion engine, the improvement comprising only one faucet joint, said front bracket and said intermediate bracket together integrally forming a first integral part containing said overrunning clutch, said shift lever and said pinion, and said rear bracket and said yoke of said motor together integrally forming a second integral part with said poles secured to the inner periphery thereof, said second integral part and said first integral part being connected together by said faucet joint.

2. The improvement as claimed in claim 1, further comprising a number of through bolts, said first and second integral parts being connected together by said number of through bolts with the ends of said bolts being secured into them, respectively.

3. The improvement as claimed in claim 1, wherein the commutator of said motor is located near said faucet joint.

4. The improvement as in claim 1, wherein said first integral part comprises an annular groove in said faucet joint, said improvement further comprising a brush holder base mounted in said annular groove so as to directly abut said first integral bracket.

5. The improvement as in claim 3, wherein said first integral part comprises an annular groove in said faucet joint, said improvement further comprising a brush holder base mounted in said annular groove so as to directly abut said first integral bracket, and brushes mounted on said brush holder base so as to contact said commutator.

6. The improvement as in claim 5, further comprising a disc mounted in said groove between said gear train and said brush holder base.

7. The improvement as in claim 6, further comprising a spur gear mounted in said groove in abutment with said disc in mesh with said gear train.

* * * * *